US010599064B2

(12) United States Patent
Yamashita et al.

(10) Patent No.: US 10,599,064 B2
(45) Date of Patent: Mar. 24, 2020

(54) POWDER-AMOUNT DETECTION DEVICE AND IMAGE FORMING APPARATUS INCORPORATING SAME

(71) Applicants: Masahide Yamashita, Tokyo (JP); Taku Kumiya, Kanagawa (JP); Yohei Kushida, Hyogo (JP); Takuya Murata, Tokyo (JP); Keita Maejima, Kanagawa (JP)

(72) Inventors: Masahide Yamashita, Tokyo (JP); Taku Kumiya, Kanagawa (JP); Yohei Kushida, Hyogo (JP); Takuya Murata, Tokyo (JP); Keita Maejima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/984,816

(22) Filed: May 21, 2018

(65) Prior Publication Data

US 2018/0341199 A1 Nov. 29, 2018

(30) Foreign Application Priority Data

May 24, 2017 (JP) ..... 2017-102509

(51) Int. Cl.
*G03G 15/08* (2006.01)
*G03G 15/00* (2006.01)

(52) U.S. Cl.
CPC ..... *G03G 15/0865* (2013.01); *G03G 15/086* (2013.01); *G03G 15/556* (2013.01);
(Continued)

(58) Field of Classification Search
CPC ..... G03G 15/0865; G03G 2215/1623; G03G 2215/1661; G03G 15/0825;
(Continued)

(56) References Cited

U.S. PATENT DOCUMENTS 5,465,619 A * 11/1995 Sotack ..... G01F 23/265 118/694
5,655,199 A 8/1997 Yamashita et al.
(Continued)

FOREIGN PATENT DOCUMENTS

JP 2000305348 A * 11/2000
JP 2004170438 A * 6/2004
(Continued)

OTHER PUBLICATIONS

U.S. Appl. No. 08/639,961, filed Apr. 29, 1996, Jun Aoto, et al.
U.S. Appl. No. 09/033,643, filed Mar. 3, 1998, Mitsuru Seto, et al.

*Primary Examiner* — David M. Gray
*Assistant Examiner* — Laura Roth
(74) *Attorney, Agent, or Firm* — Harness, Dickey & Pierce, P.L.C.

(57) ABSTRACT

A powder-amount detection device includes a first electrode, a second electrode, a third electrode and a voltage detector with the second electrode adjacent to the first electrode on the powder container and have a smaller surface area than a surface area of the first electrode. The third electrode is on a side opposite to the second electrode with the powder container interposed between the third electrode and each of the first electrode and the second electrode. The voltage detector detects voltages of the first electrode and the second electrode by detecting charging and discharging behaviors of the first electrode and the second electrode when a voltage is applied between the third electrode and each of the first electrode and the second electrode for a short time, and detects the amount of powder in the powder container based on the voltages of the first electrode and the second electrode.

20 Claims, 3 Drawing Sheets

(52) U.S. Cl.
CPC . *G03G 15/0867* (2013.01); *G03G 2215/0888* (2013.01); *G03G 2215/1623* (2013.01); *G03G 2215/1661* (2013.01)

(58) Field of Classification Search
CPC ..... G03G 15/0851; G03G 15/086; G03G 15/0867; G03G 2215/0888; G03G 15/0831
See application file for complete search history.

(56) References Cited

U.S. PATENT DOCUMENTS 5,761,594 A 6/1998 Seto et al.
5,774,775 A 6/1998 Aoto et al.
5,987,269 A * 11/1999 Allen ..... G03G 15/086 399/27
2007/0065166 A1* 3/2007 Takiguchi ..... G03G 21/12 399/35
2009/0040262 A1* 2/2009 Watanabe ..... B41J 2/17509 347/19
2011/0314907 A1* 12/2011 Wiedekind-Klein ..... G01F 23/268 73/304 C
2012/0263485 A1* 10/2012 Oba ..... G03G 15/105 399/57
2013/0308965 A1* 11/2013 Tsuchiya ..... G03G 15/086 399/27
2016/0223950 A1* 8/2016 Kato ..... G03G 15/086
2018/0039221 A1 2/2018 Nakamoto et al.
2018/0143564 A1* 5/2018 Asanuma ..... G03G 15/086
2018/0348673 A1* 12/2018 Kumiya ..... G03G 15/162

FOREIGN PATENT DOCUMENTS

JP 2004-286792 10/2004
JP 2009-116120 5/2009
JP 2012-220625 11/2012

* cited by examiner

POWDER-AMOUNT DETECTION DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2017-102509, filed on May 24, 2017, in the Japan Patent Office, the entire disclosure of which is hereby incorporated by reference herein.

BACKGROUND

Technical Field

Aspects of the present disclosure relate to a powder-amount detection device and an image forming apparatus to detect the amount of powder in a powder container.

Related Art

Typically, an electrophotographic image forming apparatus includes a replaceable toner bottle to replenish toner for image formation. To reduce the user's downtime caused by the replacement of toner bottles, various devices have been proposed to detect the amount of toner in the toner bottle and grasp the bottle replacement timing beforehand.

SUMMARY

In an aspect of the present disclosure, there is provided a powder-amount detection device that includes a first electrode, a second electrode, a third electrode, and a voltage detector. The first electrode is disposed on one side of a powder container to be replaceably installed to an image forming apparatus. The second electrode is disposed adjacent to the first electrode and having a smaller surface area than a surface area of the first electrode. An influence of an amount of powder in the powder container to a capacitance of the second electrode is as small as negligible. The third electrode is disposed on a side opposite to the second electrode with the powder container interposed between the third electrode and each of the first electrode and the second electrode. The voltage detector is configured to detect voltages of the first electrode and the second electrode. The voltage detector is configured to detect charging and discharging behaviors of the first electrode and the second electrode when a voltage is applied between the third electrode and each of the first electrode and the second electrode for a short time, to detect the amount of powder in the powder container.

In another aspect of the present disclosure, there is provided an image forming apparatus that includes an image forming unit and the powder-amount detection device disposed in the image forming unit.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
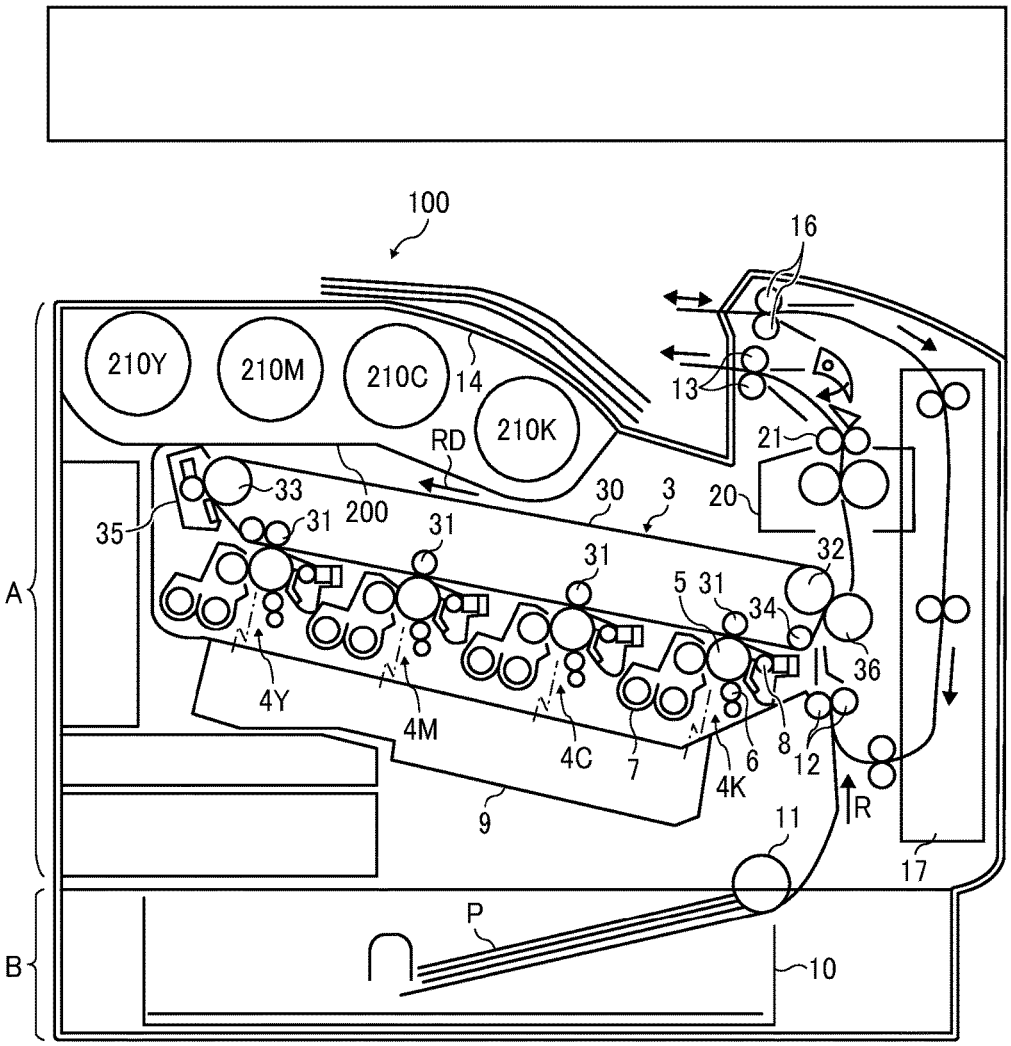
FIG. 1 is a schematic diagram of an image forming apparatus including a powder-amount detection device according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, a powder-amount detection device according to an embodiment of the present disclosure and an image forming apparatus including the powder-amount detection device are described with reference to the drawings.

Image Forming Apparatus

First, the overall configuration of the image forming apparatus according to an embodiment of the present disclosure is described below. An image forming apparatus 100 illustrated in FIG. 1 is a color laser printer and includes, e.g., an image forming section A, a sheet feeding section B, a pair of sheet ejection rollers 13, a sheet ejection tray 14, a fixing device 20, and a curl correcting device 21. The image forming section A includes, e.g., four image forming units 4Y, 4M, 4C, and 4K, which are described later, an exposure device 9, and a transfer device 3. A further description is given below of the image forming section A.

In a middle of an image forming apparatus body of the image forming apparatus 100, four image forming units 4Y, 4M, 4C, and 4K are disposed. The image forming units 4Y, 4M, 4C, and 4K have the same configuration except for accommodating developers of different colors of yellow (Y), magenta (M), cyan (C), and black (K) corresponding to color separation components of a color image.

For example, each of the image forming units 4Y, 4M, 4C, and 4K includes a drum-shaped photoconductor 5 as a latent image bearer, a charging device 6 to charge a surface of the photoconductor 5, a developing device 7 to supply toner as powder, and a cleaning device 8 to clean the surface of the photoconductor 5.

In FIG. 1, the photoconductor 5, the charging device 6, the developing device 7, and the cleaning device 8 included in the image forming unit 4K for black are denoted by reference numerals. The other image forming units 4Y, 4M, and 4C have the same structure as the image forming unit 4K for black.

The exposure device 9 to expose the surface of each photoconductor 5 is disposed below each of the image forming units 4Y, 4M, 4C, and 4K. The exposure device 9 includes, e.g., a laser light source, a polygon mirror, an f-θ lens, a plurality of reflection mirrors and irradiates the surface of each photoconductor 5 with a laser beam according to image data, thus forming an electrostatic latent image on the surface of each photoconductor 5.

The transfer device 3 is disposed above each of the image forming units 4Y, 4M, 4C, and 4K. The transfer device 3 includes an intermediate transfer belt 30 as an intermediate transfer member, four primary transfer rollers 31 as primary transfer members, a secondary transfer roller 36 as a secondary transfer member, a secondary transfer backup roller 32, a cleaning backup roller 33, a tension roller 34, and a belt cleaning device 35.

The intermediate transfer belt 30 is an endless belt, and is stretched taut by the secondary transfer backup roller 32, the cleaning backup roller 33, and the tension roller 34. Here, as the secondary transfer backup roller 32 is driven to rotate, the intermediate transfer belt 30 circulates (rotates) in a direction indicated by arrow RD in FIG. 1.

Each of the four primary transfer rollers 31 sandwiches the intermediate transfer belt 30 with each photoconductor 5, to form a primary transfer nip. A power supply is connected to each of the primary transfer rollers 31 so that a predetermined direct current (DC) voltage or a predetermined alternating current (AC) voltage is applied to each primary transfer roller 31.

The secondary transfer roller 36 sandwiches the intermediate transfer belt 30 with the secondary transfer backup roller 32, to form a secondary transfer nip. Similarly with the primary transfer roller 31, a power supply is also connected to the secondary transfer roller 36 so that a predetermined DC voltage or AC voltage is applied to the secondary transfer roller 36.

The belt cleaning device 35 includes a cleaning brush and a cleaning blade that are disposed so as to contact the intermediate transfer belt 30. Waste toner collected by the belt cleaning device 35 is accommodated in a waste toner container via a waste toner drain tube.

Figure 2:
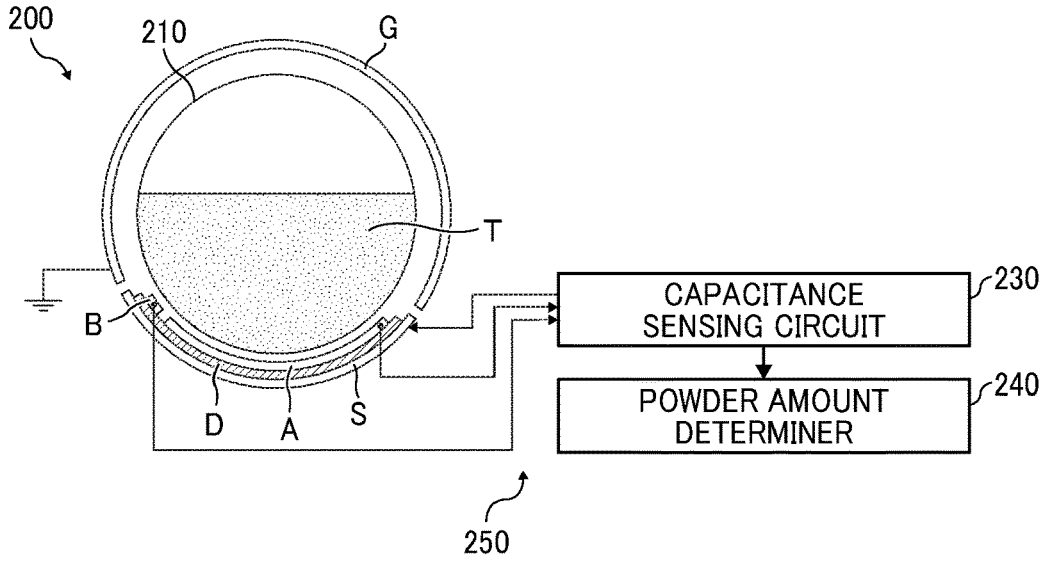
FIG. 2 is a cross-sectional view of a powder-amount detection device according to an embodiment of the present disclosure, disposed on an outer periphery of a toner bottle.
Figure 3A:
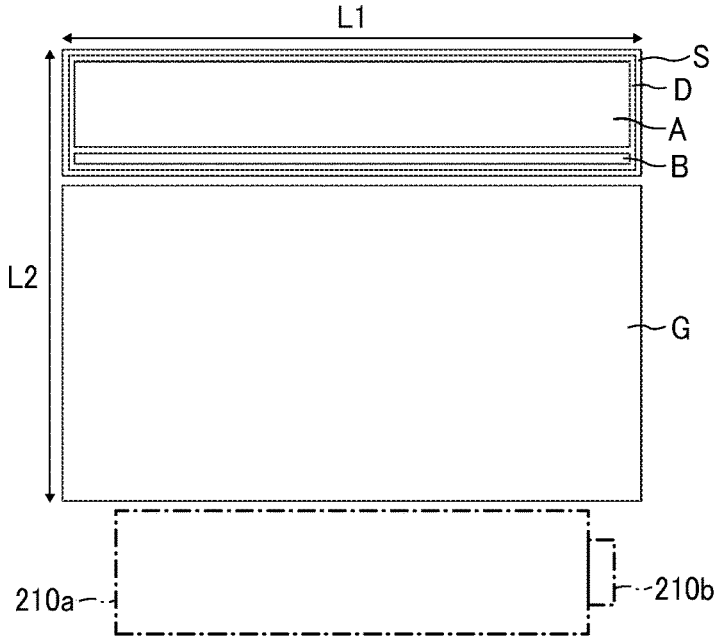
FIG. 3A is a plan view of electrodes of the powder-amount detection device disposed on the outer periphery of the toner bottle in an expanded state.
Figure 3B:
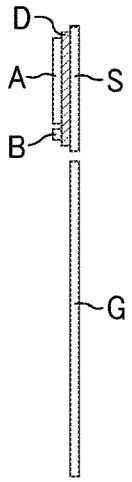
FIG. 3B is a side view of the electrodes of FIG. 3A.

At an upper part of the image forming apparatus body, a bottle housing 200 is disposed. In the bottle housing 200, four toner bottles 210Y, 210M, 210C, and 210K as powder containers to store replenishment toner are replaceably mounted. Toner as powder is supplied from each of the toner bottles 210Y, 210M, 210C, and 210K to each developing device 7 via a replenishment path disposed between each of the toner bottles 210Y, 210M, 210C, 210K and each developing device 7. Around each of the toner bottles 210Y, 210M, 210C, and 210K, a toner-amount detection device 250 as a powder-amount detection device described later with reference to FIGS. 2, 3A, and 3B is disposed.

On the other hand, at a lower part of the image forming apparatus body of the image forming apparatus 100, the sheet feeding section B is disposed. The sheet feeding section B includes, e.g., a sheet feed tray 10 to accommodate recording media P as sheet-shaped materials (recording media) and a sheet feed roller 11 to feed the recording media P from the sheet feed tray 10.

Examples of the recording media P include thick paper, postcards, envelopes, thin paper, coated paper (or art paper), tracing paper, and OHP sheets, in addition to plain paper. The image forming apparatus 100 may further include a bypass sheet feeding mechanism. In the present embodiment, "thick paper" means paper having a basis weight of 160 $g/m^2$ or more.

In the image forming apparatus body, a conveyance path R to eject the recording medium P from the sheet feed tray 10 through the secondary transfer nip to the outside of the image forming apparatus 100. On the conveyance path R, a pair of registration rollers 12 as timing rollers to convey the recording medium P to the secondary transfer nip at proper conveyance timing is disposed at an upstream side from the position of the secondary transfer roller 36 in a conveyance direction of the recording medium P.

Further, on a downstream side from the position of the secondary transfer roller 36 in the conveyance direction of the recording medium P, the fixing device 20 is disposed that presses and heats the recording medium P bearing an unfixed toner image to fix the toner image on the recording medium P. A pair of sheet ejection rollers 13 to eject the recording medium P to the outside of the image forming apparatus 100 is disposed on the downstream side from the fixing device 20 in the conveyance direction of the recording medium P on the conveyance path R. The sheet ejection tray 14 to stock the recording medium P ejected outside the image forming apparatus 100 is disposed on an upper surface of the image forming apparatus body.

Basic Operation of Image Forming Apparatus

Next, a basic operation of the image forming apparatus 100 according to the present embodiment is described. First, when image forming operation is started, each photoconductor 5 in each of the image forming units 4Y, 4M, 4C, and 4K is driven to rotate clockwise in FIG. 1, and the surface of each photoconductor 5 is uniformly charged by the charging device 6 to a predetermined polarity. The surface of each charged photoconductor 5 is irradiated laser light from the exposure device 9 and an electrostatic latent image is formed on the surface of each photoconductor 5.

Here, image data to be exposed on each photoconductor 5 is monochromatic image data obtained by decomposing a full-color image into color data of yellow, magenta, cyan and black. As toner is supplied to the electrostatic latent image formed on each photoconductor 5 by each developing device 7, the electrostatic latent image is visualized as an image.

When the image forming operation is started, the secondary transfer backup roller 32 is driven to rotate counterclockwise in FIG. 1, thus causing the intermediate transfer belt 30 to travel around in the direction indicated by arrow RD in FIG. 1. In addition, as a constant voltage or a constant-current-controlled voltage having a polarity opposite to the charging polarity of the toner is applied to each primary transfer roller 31, A transfer electric field is formed in the primary transfer nip between each primary transfer roller 31 and each photoconductor 5.

Then, when the image of the corresponding color on each photoconductor 5 reaches the primary transfer nip with the rotation of each photoconductor 5, the image on each photoconductor 5 is sequentially transferred onto the intermediate transfer belt 30 in a superimposed manner by action of the transfer electric field formed at the primary transfer nip.

Thus, a full-color image is borne on the surface of the intermediate transfer belt 30. Toner on each photoconductor 5 that has not been transferred to the intermediate transfer belt 30 is removed by the cleaning device 8. The surface of each photoconductor 5 is neutralized by a neutralizing device, and the surface potential is initialized.

In a lower portion of the image forming apparatus 100, the sheet feed roller 11 starts to rotate, and the recording medium P is sent out from the sheet feed tray 10 to the conveyance path R. The conveyance of the recording medium P fed to the conveyance path R is temporarily stopped by the pair of registration rollers 12.

Then, the pair of registration roller 12 starts to rotate at a predetermined timing, and the recording medium P is conveyed to the secondary transfer nip at the timing when the images on the intermediate transfer belt 30 reaches the secondary transfer nip. At this time, the secondary transfer roller 36 is applied with a transfer voltage having the polarity opposite to the charging polarity of toner of the images on the intermediate transfer belt 30, thus forming a transfer electric field in the secondary transfer nip.

By the transfer electric field, the images on the intermediate transfer belt 30 are collectively transferred onto the recording medium P. Residual toner on the intermediate transfer belt 30 that has not been transferred to the recording medium P is removed by the belt cleaning device 35 and drained to the waste toner container.

Then, the recording medium P is conveyed to the fixing device 20, and the images on the recording medium P are fixed on the recording medium P by the fixing device 20. The recording medium P conveyed from the fixing device 20 passes through the curl correcting device 21 and is ejected onto the sheet ejection tray 14 outside the image forming apparatus body.

Although the above-described description is about the image forming operation performed when a full color image is formed on the recording medium P, the image forming apparatus 100 can form a single color image using any one of the four image forming units 4Y, 4M, 4C, and 4K or form images of two or three colors using any two or three of the image forming units 4Y, 4M, 4C, and 4K.

Toner-Amount Detection Device

Next, the toner-amount detection device 250 to detect the amount of toner in the toner bottle 210 is described. As illustrated in FIG. 2, the toner bottle 210 is molded in a cylindrical shape and accommodates the toner T in the toner bottle 210. As illustrated in FIG. 3A, the toner bottle 210 has a bottom portion 210*a* on one end side and a circular toner supply port 210*b* as a powder supply port on the other end side. The toner bottle 210 is replaceably set in the bottle housing 200 with the axis of the toner bottle 210 being horizontal.

Spiral ribs or grooves are formed on an inner circumferential surface of the toner bottle 210 so that toner T can be moved toward the toner supply port 210*b* by the rotation of the toner bottle 210. A driving device to rotate the toner bottle 210 is disposed in the bottle housing 200.

A total of four electrodes including a first electrode A, a second electrode B, a driving electrode S, and a ground electrode G, are disposed on the outer periphery of the toner bottle 210. The first electrode A, the second electrode B, and the driving electrode S, excluding the ground electrode G, are connected to a capacitance sensing circuit 230. The capacitance sensing circuit 230 is connected to a powder amount determiner 240. The capacitance sensing circuit 230 functions as a voltage detector to detect the voltages of the first electrode A and the second electrode B.

The first electrode A is disposed adjacent to a lower bottom of the toner bottle 210 as illustrated in FIG. 2. The first electrode A has an arcuate cross section along the outer circumferential surface of the toner bottle 210 and extends over almost the entire length of the toner bottle 210 in a longitudinal direction of the toner bottle 210 as indicated by arrow L1 in FIGS. 3A and 3B.

The circumferential center of the arcuate cross section of the first electrode A is located right under the center of the toner bottle 210. Both ends of the arcuate cross section of the first electrode A extend in a lateral direction in FIG. 2 from the center. The circumferential width of the first electrode A may be any width as long as the width at which the first electrode A can detect toner T in the toner bottle 210 until the toner T runs out. The circumferential width illustrated in FIG. 2 is close to 90° as a central angle, which is one example and the circumferential width is not limited to the example illustrated in FIG. 2.

The second electrode B is disposed adjacent to one side of the first electrode A in the circumferential direction of the first electrode A. A slight gap in the circumferential direction is formed between the first electrode A and the second electrode B. The circumferential width of the second electrode B is set to be sufficiently smaller (for example, one tenth or less) than the circumferential width of the first electrode A so as not to be substantially affected by capacitance as described later. The longitudinal direction of the second electrode B also extends over almost the entire length of the toner bottle 210 similarly with the first electrode A.

The gap between the second electrode B and the outer circumferential surface of the toner bottle 210 has the same size as the gap between the first electrode A and the outer circumferential surface of the toner bottle 210. The gaps can prevent the friction charging potential from being generated by the contact with the toner bottle 210.

The driving electrode S is disposed on the outer side of, that is, radially outward (downward) of the first electrode A and the second electrode B with a thin dielectric layer D interposed between the first electrode A and the second electrode B. The first electrode A and the second electrode B are completely covered with the driving electrode S.

The driving electrode S charges and discharges the first electrode A and the second electrode B by applying the first electrode A and the second electrode B for a very short time with the voltage of a signal source of the capacitance sensing circuit 230. The driving electrode S has an arcuate cross section (of a central angle of about 120°) along the outer circumferential surfaces of the toner bottle 210, the first electrode A, and the second electrode B. Similarly with the first electrode A, the driving electrode S extends over almost the entire longitudinal length of the toner bottle 210.

The ground electrode G as a third electrode is disposed opposite the first electrode A and the second electrode B with the toner bottle 210 interposed between the ground electrode G and each of the first electrode A and the second electrode B. The ground electrode G has an arcuate cross section (of a central angle of about 270°) along the outer circumference of the toner bottle 210. Both circumferential ends of the ground electrode G are spaced with slight gaps from both circumferential ends of the driving electrode S. As indicated by arrow L2 in FIG. 3B, a total of the circumferential length of the driving electrode S and the circumferential length of the ground electrode S with a gap is slightly longer than the entire circumferential length of the toner bottle 210.

The ground electrode G is grounded (earthed) via a lead wire. Grounding the ground electrode G can cut the capacitance above (in an infinite direction of) the toner bottle 210, thus stabilizing the detection signal entering the capacitance sensing circuit 230 and improving the detection accuracy.

The length of each of the electrodes A, B, S, and G is preferably slightly longer than the entire longitudinal length of the toner bottle 210 as indicated by arrow L1 in FIG. 3A. Such a configuration can reduce electric field noise at ends of the electrodes.

Operation of Toner-Amount Detection Device

The first electrode A detects both capacitance and external noise according to toner amount. Similarly, the second electrode B detects both capacitance and external noise.

However, the electrode surface area of the second electrode B is sufficiently smaller than the electrode surface area of the first electrode A, so the influence of the toner amount on the capacitance is extremely small and can be neglected. For the external noise, the first electrode A and the second electrode B detect the external noise in substantially the same manner regardless of the electrode surface areas of the first electrode A and the second electrode B.

Since the first electrode A and the second electrode B have the same length in the axial direction of the toner bottle 210, the magnitude of the external noise is also substantially the same between the first electrode A and the second electrode B. Therefore, by simply inverting the detection signal of the second electrode B and superimposing the inverted detection signal on the detection signal of the first electrode A, the external noise can be easily removed, thus obviating complex signal processing. Accordingly, an additional arithmetic circuit is obviated. The detection accuracy can be stabilized while reducing an increase in the cost of the apparatus.

The voltage of each of the first electrode A and the second electrode B is detected by the capacitance sensing circuit 230. The capacitance sensing circuit 230 detects the difference in capacitance between the first electrode A and the second electrode B, thus allowing detection of only the capacitance caused by the toner amount. The difference is obtained by subtracting the product of the noise detected by the second electrode B and a certain magnification from the signal detected by the first electrode A. At this time, since the toner bottle 210 is covered with the ground electrode G, the range of detection with the first electrode A and the second electrode B can be limited to only the inside of the toner bottle 210.

By connecting the first electrode A and the second electrode B to the capacitance sensing circuit 230, a capacitor circuit is formed between the first electrode A, the second electrode B, and the ground electrode G. When detecting the amount of toner, the first electrode A and the second electrode B are charged and discharged by applying a voltage to the driving electrode S for a very short time. From the charging and discharging behavior (e.g., change in charge voltage, oscillation frequency, or discharge time), the capacitance of a capacitor formed by the electrode A and the electrode B is detected.

When the first electrode A and the second electrode B are charged and discharged by applying a voltage to the driving electrode S, the first electrode A and the second electrode B can be charged at completely the same timing and completely the same potential, thus eliminating the time lag (including the time lag of noise) of the detection signal entering the capacitance sensing circuit 230. Therefore, an additional circuit, such as a delay circuit, can be obviated, and the detection accuracy of the toner amount can be improved while reducing the cost of the apparatus.

The voltage applied to the driving electrode S can be a single pulse voltage, a DC pulse voltage (including a single pulse voltage), or an AC voltage. For the AC voltage, detection is performed while repeating charging and discharging. Accordingly, a sudden abnormal value can be eliminated, thus improving the detection accuracy of the toner amount.

The capacitance varies with the relative dielectric constant of the substance existing between the electrodes as a parameter. Therefore, the amount of the toner T existing in the toner bottle having a different dielectric constant from air can be found by detecting the capacitance. However, even if simply the capacitance between the first electrode A and the ground electrode G is attempted to be obtained, external noise (for example, fluctuation of the surrounding electric field) cannot be ignored, thus hampering detection of a stable capacitance.

In addition, since the relative dielectric constant of the toner T is relatively small and the change of the capacitance is extremely small, the difficulty in detection of the capacitance may further increase. In the present embodiment, the detection of capacitance between the second electrode B and the ground electrode G is also performed at the same time as the detection of capacitance between the first electrode A and the ground electrode G. Detecting the difference in capacitance between the first electrode A and the second electrode B allows the external noise to be canceled (offset).

Normally, external noise occurs due to, e.g., a change in a peripheral electric field as described above and, for example, occurs since the detection electrode behaves like an antenna. Hence, the second electrode B having a quite smaller surface area than a surface are of the first electrode A and having a length equal to a length of the first electrode A (or an integer fraction of the first electrode A) is used together the first electrode A as the detection electrode, thus allowing the external noise equivalent to the external noise of the first electrode A to be detected even in the second electrode B.

Since the second electrode B has a quite smaller surface area than the surface area of the first electrode A, the sensitivity to the amount of toner in the toner bottle is very small and substantially negligible. Therefore, in the first electrode A, a capacitance in which a change in capacitance due to the amount of toner is superimposed on external noise are detected. On the other hand, in the second electrode B adjacent to the first electrode A, a capacitance corresponding to substantially only external noise is detected.

By using the capacitances of the first electrode A and the second electrode B, the external noise can be cancelled, thus allowing detection of the value of the capacitance caused only by a change of the toner amount. In this way, the amount of toner in the toner bottle 210 can be very accurately detected regardless of disturbance (electric noise).

Also, by using the driving electrode S as the driving electrode of the first electrode A and the second electrode B, the charging and discharging for the first electrode A and the second electrode B can be performed at completely the same time and completely at the same applied voltage. In addition, noise at the time of voltage application can be eliminated. Such a configuration allows further stable detection of the capacitance.

In addition, since the ground electrode G is disposed to cover the periphery of the toner bottle 210, the change in the capacitance is limited to a range of change due to the state change in the toner bottle 210. At the same time, by the use of the driving electrode S, the capacitor circuit formed by the first electrode A and the second electrode B is limited to between the ground electrode G, the first electrode A, and the second electrode B.

Therefore, the detection range of capacitance is a whole area enclosed by the first electrode A, the second electrode B, and the ground electrode G, and is a range that does not include other areas than the whole area. Such a configuration can prevent fluctuation of capacitance caused by a change in the position of the toner T in the toner bottle 210 and a change in the volume of detection space is not caused, thus allowing detection of only a change in the toner amount.

Although some embodiments of the present disclosure have been described above, the present invention is not limited to the above-described embodiments, and various variations and modifications are possible within the scope of the technical idea described in the claims. For example, in the above-described embodiment, the toner bottle 210 is illustrated in a cylindrical shape for the sake of convenience of expression, and a plurality of electrodes are illustrated in a concentric cylindrical shape with the cylindrical shape. However, such shapes can be arbitrarily changed as long as they do not deviate from constitutional requirements of the present invention.

Figure 4:
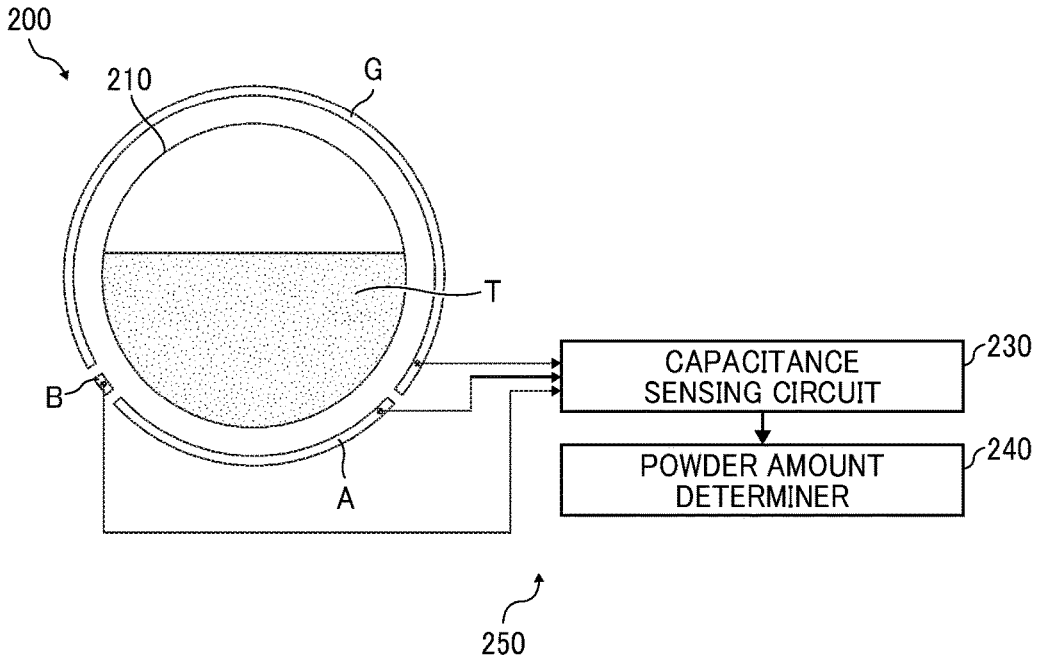
FIG. 4 is a cross-sectional view of a variation of the powder-amount detection device.

In the above-described embodiment, the driving electrode S is provided as the driving electrode of the first electrode A and the second electrode B. However, as in a variation of the toner-amount detection device 250 illustrated in FIG. 4, the first electrode A and the second electrode B may be directly charged and discharged by a signal source in the capacitance sensing circuit 230, instead of using the driving electrode S. The third electrode may not be the ground electrode G. As in the variation of FIG. 4, the third electrode G may be connected to the capacitance sensing circuit 230 and charged and discharged similarly with the first electrode A and the second electrode B.

In the above-described embodiment, the four electrodes A, B, S, and G are disposed in the bottle housing 200. In some embodiments, such electrodes and the dielectric layer D may be arranged integrally with, e.g., a product number label of the outer circumferential surface of the toner bottle 210. Such a configuration can bring the electrodes into close contact with the surface of the toner bottle, thus reducing a detection error due to an attached state of the toner bottle and improving the detection accuracy of the toner amount. In such a case, the rotation stop position of the toner bottle 210 is preferably constant to facilitate the arrangement of an electrode contact of the bottle housing 200 on the image forming apparatus body side to establish electrical connection with a bottle-side electrode.

What is claimed is:

1. A powder-amount detection device comprising:

a first electrode on one side of a powder container, the powder container being replaceably installable in an image forming apparatus;

a second electrode adjacent to the first electrode on the powder container, the second electrode having a smaller surface area than a surface area of the first electrode, an influence of an amount of powder in the powder container to a capacitance of the second electrode being as small as negligible;

a third electrode on a side opposite to the second electrode with the powder container interposed between the third electrode and each of the first electrode and the second electrode; and a voltage detector configured to, detect voltages of the first electrode and the second electrode by detecting charging and discharging behaviors of the first electrode and the second electrode when a voltage is applied between the third electrode and each of the first electrode and the second electrode for a short time, and detect the amount of powder in the powder container based on the voltages of the first electrode and the second electrode.

2. The powder-amount detection device according to claim 1, wherein the voltage detector is configured to, detect a capacitance from a value obtained by subtracting a voltage obtained from the second electrode from a voltage obtained from the first electrode, and detect the amount of powder in the powder container based on the capacitance.

3. The powder-amount detection device according to claim 1, further comprising:

a dielectric layer on an outer side of the first electrode and the second electrode with respect to the powder container; and a driving electrode at an outer side of the dielectric layer with respect to the powder container with the dielectric layer interposed between the driving electrode and each of the first electrode and the second electrode, wherein the voltage detector is configured to apply a voltage to the driving electrode for the short time to charge and discharge the first electrode and the second electrode.

4. The powder-amount detection device according to claim 3, wherein the voltage applied to the driving electrode is an alternating current voltage.

5. The powder-amount detection device according to claim 1, wherein the third electrode is a ground electrode earthed to ground.

6. The powder-amount detection device according to claim 1, wherein the first electrode and the second electrode have a same length in a longitudinal direction of the powder container having a cylindrical shape.

7. The powder-amount detection device according to claim 1, wherein the first electrode, the second electrode, and the third electrode are in non-contact with the powder container.

8. An image forming apparatus comprising:

an image forming unit including the powder container; and the powder-amount detection device according to claim 1, the powder-amount detection device configured to detect the amount of powder in the powder container.

9. A powder-amount detection device configured to detect an amount of powder in a powder container replaceably installable in an image forming apparatus, the powder-amount detection device comprising:

a voltage detector configured to, detect voltages of a first electrode and a second electrode by detecting charging and discharging behaviors of the first electrode and the second electrode when a voltage is applied between a third electrode and each of the first electrode and the second electrode for a period of time, the first electrode being on one side of the powder container and having a first surface area, the second electrode being adjacent to the first electrode on the powder container and having a second surface area, the second surface area being smaller than the first surface area, an influence of an amount of powder in the powder container to a capacitance of the second electrode being as small as negligible, and the third electrode being on a side opposite to the second electrode with the powder container interposed between the third electrode and each of the first electrode and the second electrode, and detect the amount of powder in the powder container based on the voltages of the first electrode and the second electrode.

10. The powder-amount detection device according to claim 9, wherein the voltage detector is configured to, detect a capacitance from a value obtained by subtracting a voltage obtained from the second electrode from a voltage obtained from the first electrode, and detect the amount of powder in the powder container based on the capacitance.

11. The powder-amount detection device according to claim 9, wherein powder-amount detection device is configured to detect the amount of powder in the powder container while the first electrode, the second electrode, and the third electrode are not in contact with the powder container.

12. An image forming apparatus comprising:

an image forming unit including the powder container; and the powder-amount detection device according to claim 9, the powder-amount detection device configured to detect the amount of powder in the powder container.

13. A powder-amount detection device configured to detect an amount of a powder container replacably installable in an image forming apparatus, the powder-amount detection device comprising:

a first electrode;

a second electrode having a smaller surface area than a surface area of the first electrode, an influence of the amount of the powder in the powder container to a capacitance of the second electrode being as small as negligible; and a third electrode positioned relative to the first electrode and the second electrode such that the powder container is selectively interposed between the third electrode and each of the first electrode and the second electrode, wherein the first electrode and the second electrode have a same length in a longitudinal direction of the powder container having a cylindrical shape.

14. The powder-amount detection device according to claim 13, further comprising:

a voltage detector configured to, detect voltages of the first electrode and the second electrode by detecting charging and discharging behaviors of the first electrode and the second electrode when a voltage is applied between the third electrode and each of the first electrode and the second electrode for a period of time, and detect the amount of the powder in the powder container based on the voltages of the first electrode and the second electrode.

15. The powder-amount detection device according to claim 14, wherein the voltage detector is configured to, detect a capacitance from a value obtained by subtracting a voltage obtained from the second electrode from a voltage obtained from the first electrode, and detect the amount of the powder in the powder container based on the capacitance.

16. The powder-amount detection device according to claim 14, further comprising:

a dielectric layer on an outer side of the first electrode and the second electrode with respect to the powder container; and a driving electrode at an outer side of the dielectric layer with respect to the powder container with the dielectric layer interposed between the driving electrode and each of the first electrode and the second electrode, wherein the voltage detector is configured to apply a voltage to the driving electrode for the period of time to charge and discharge the first electrode and the second electrode.

17. The powder-amount detection device according to claim 13, wherein the third electrode is a ground electrode earthed to ground.

18. The powder-amount detection device according to claim 13, wherein the first electrode, the second electrode, and the third electrode are in non- contact with the powder container.

19. An image forming apparatus comprising:

an image forming unit including the powder container; and the powder-amount detection device according to claim 13, the powder-amount detection device configured to detect the amount of the powder in the powder container.

20. The powder-amount detection device according to claim 13, wherein the first electrode and the second electrode are configured to charge and discharge to form a capacitor in response to a voltage applied between the third electrode and each of the first electrode and the second electrode.

* * * * *